US011261890B2

(12) United States Patent
Alhussan

(10) Patent No.: US 11,261,890 B2
(45) Date of Patent: Mar. 1, 2022

(54) HIGH SPEED ROTATING BODIES WITH TRANSVERSE JETS AS A FUNCTION OF ANGLE OF ATTACK, REYNOLDS NUMBER, AND VELOCITY OF THE JET EXIT

(71) Applicant: Khaled Abdullah Alhussan, Riyadh (SA)

(72) Inventor: Khaled Abdullah Alhussan, Riyadh (SA)

( * ) Notice: Subject to any disclaimer, the term of this patent is extended or adjusted under 35 U.S.C. 154(b) by 545 days.

(21) Appl. No.: 16/204,219

(22) Filed: Nov. 29, 2018

(65) Prior Publication Data

US 2019/0162212 A1 May 30, 2019

Related U.S. Application Data

(60) Provisional application No. 62/592,101, filed on Nov. 29, 2017.

(51) Int. Cl.

| | |
|---|---|
| ***F15C 1/16*** | (2006.01) |
| ***F15D 1/00*** | (2006.01) |
| ***F15D 1/12*** | (2006.01) |

(52) U.S. Cl.

CPC ..... *F15D 1/008* (2013.01); *F15D 1/12* (2013.01); *F15D 1/0015* (2013.01)

(58) Field of Classification Search

CPC ..... F15D 1/008; F15D 1/12; F15D 1/0015
USPC ..... 244/207, 3.23; 137/808, 809, 810, 811
See application file for complete search history.

(56) References Cited

U.S. PATENT DOCUMENTS

| | | | | |
|---|---|---|---|---|
| 2,946,261 | A * | 7/1960 | Crockett | F02K 9/97 89/1.8 |
| 3,374,967 | A * | 3/1968 | Plumley | F42B 10/661 244/3.14 |
| 4,165,847 | A * | 8/1979 | Detalle | F42B 10/16 244/3.29 |
| H000112 | H * | 8/1986 | Donovan | 102/501 |
| 5,758,823 | A * | 6/1998 | Glezer | H05K 7/20172 239/4 |
| 5,788,180 | A * | 8/1998 | Sallee | F41G 7/222 244/3.15 |
| 6,119,987 | A * | 9/2000 | Kiknadze | F15D 1/12 244/204 |
| 6,666,144 | B1 * | 12/2003 | Kim | F42B 10/28 102/293 |
| 6,767,261 | B1 * | 7/2004 | Woodall | B63G 13/02 440/38 |
| 6,892,989 | B1 * | 5/2005 | Whitmore | B64C 21/10 244/200 |
| 7,823,510 | B1 * | 11/2010 | Hobart | F42B 10/40 102/490 |
| 7,891,298 | B2 * | 2/2011 | Minick | F42B 10/663 102/501 |

(Continued)

*Primary Examiner* — Minh Q Le

(74) *Attorney, Agent, or Firm* — Leavitt Eldredge Law Firm

(57) ABSTRACT

A system includes an elongated cylindrical body having a first end extending to a second end; an outer surface and an inner surface; a thickness extending from the inner surface to the outer surface; and a plurality of openings extending from the inner surface to the outer surface. The system further includes a fluid injection apparatus disposed within the elongated cylindrical body, the fluid injection apparatus is configured to pass fluid through the openings.

7 Claims, 6 Drawing Sheets

(56) References Cited

U.S. PATENT DOCUMENTS

| | | | | |
|---|---|---|---|---|
| 8,973,504 | B2 * | 3/2015 | Kim | F42B 10/44<br>102/501 |
| 2002/0190156 | A1 * | 12/2002 | Jensen | F42B 10/54<br>244/3.23 |
| 2008/0223977 | A1 * | 9/2008 | Dryer | F42B 10/14<br>244/3.22 |
| 2015/0292533 | A1 * | 10/2015 | Roy | F15D 1/0075<br>137/13 |

* cited by examiner

HIGH SPEED ROTATING BODIES WITH TRANSVERSE JETS AS A FUNCTION OF ANGLE OF ATTACK, REYNOLDS NUMBER, AND VELOCITY OF THE JET EXIT

BACKGROUND

1. Field of the Invention

The present invention relates generally to a high-speed rotating body with transverse jets and changes to the boundary layers and fluid dynamics as a function of angle of attack, Reynolds number and velocity of the jet exit.

2. Description of Related Art

Flow over external bodies has been studied extensively because of their many practical applications, in some applications of aerodynamics, a surface control of a moving body is required therefore the prediction and controlling of the forces is essential. In FIG. 1, a simplified schematic of a high-speed rotating object 101 is shown within the fluid and/or gaseous streamline indicated a plurality of arrow 103. The body rotates and transverses within the streamline at high revolutions and velocity, which in turn can create a plurality of flow separation 111 outside of body surface 109 or near the rearward section 107 of the object 101. Because of the extreme rotation and velocity it is common for the object 101 to create different shock waves. The shock waves and flow separation could results in drastic flight efficiency of the object.

Accordingly, there is a need to reduce, if not eliminate the flow separation and/or shock waves during flight. It is believed that the present invention overcomes these problems as discussed below.

It should be understood that although great strides have been made in the field of technology, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
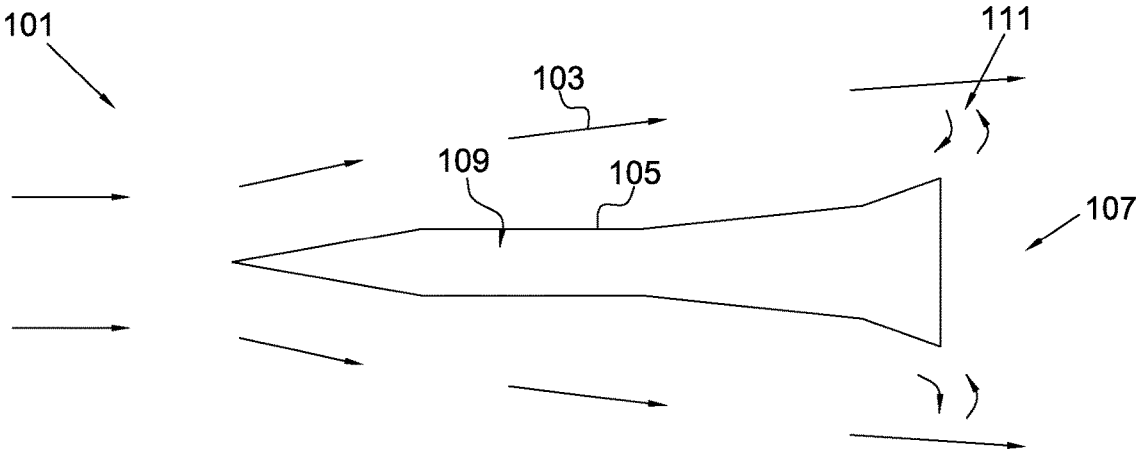
FIG. 1 is a side view of a conventional object traveling through a fluid medium.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present application incorporates one or more features of the systems and methods of the previously filed parent application, which the present application incorporates by references and claims are priority. It should be understood that an airfoil is determined as any wing and/or structure of the aircraft that creates lift or any surface structure affected by the airstream traveling around the aircraft.

The system and method of use in accordance with the present application overcomes one or more of the above-discussed problems commonly associated with conventional objects passing through an air stream at high velocities while rotating. The present invention incorporates transverse jets that inject air into the air stream, which in turn changes the flow structure around and behind the body, especially with regard to the viscous and pressure drag, shock wave interactions, boundary layer separations, recirculation, and wake. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIGS. 2-10 depicts various views of a rotating body system 201 in accordance with one preferred embodiment of the present application. It will be appreciated that system 201 overcomes one of more of the above-listed problems commonly associated with conventional rotating objects passing through an air stream at high-speeds.

Figure 2:
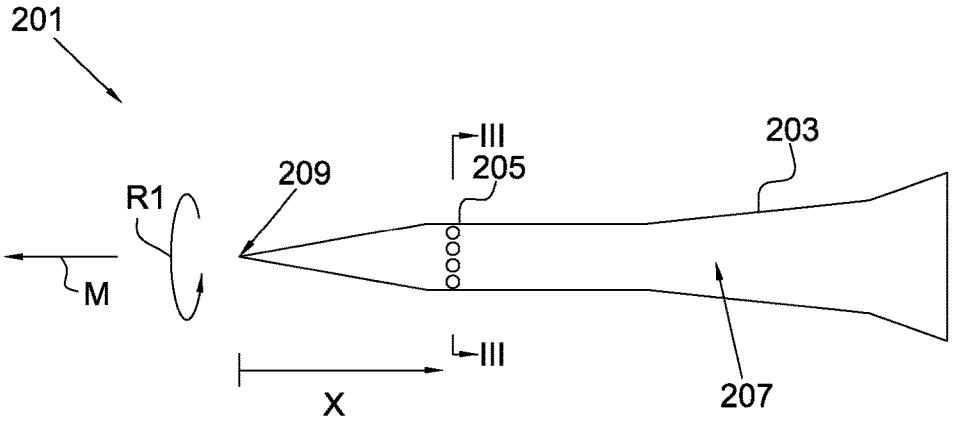
FIG. 2 is a side view of the rotating body system in accordance with a preferred embodiment of the present application.
Figure 3:
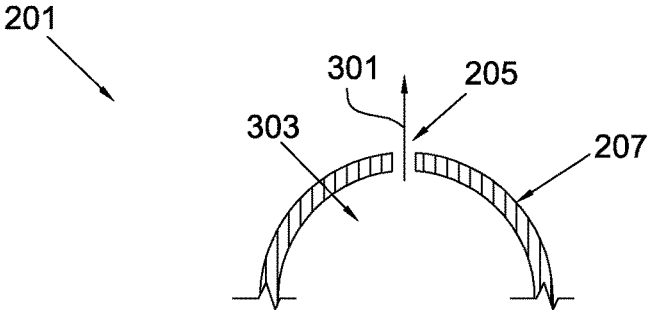
FIG. 3 is a cross-sectional view of the rotating body system of FIG. 2 taking as III-III.

Referring specifically to FIGS. 2 and 3 in the drawings, a side view of the rotating object system 201 is shown having a cylindrical body 203 rotating at an angular speed indicated by arrow R1. In one contemplated embodiment, the angular speed is approximately 10,000 RPM; however, it will be appreciated that alternative embodiments could rotate at different speeds. Also, the contemplated embodiment is traveling at Mach number indicated by arrow M of approximately Mach 2; however, it will be appreciated that alternative embodiments could have different speeds. Overall, the rotation and speed is indicative of the high-speed and high-rotational movements of the body 203 as it passes through the air stream.

System 201 is further provided with a plurality of jet openings 205 positioned at a distance indicated by arrow X from the tip 209 of the body 203. During flight, jets of air 301 passes through openings 205 from within an inner area 303 of body 205. It is believed that the jets provide significant improvement in the flow characteristics around body surface 207 as the object passes through the air stream. In the preferred embodiment, air is the working fluid; however, it will be appreciated that having jets injected at an angle relative to the outer surface can cause similar affects to the stream of fluid passing over the rotating body at high speeds.

Figure 4:
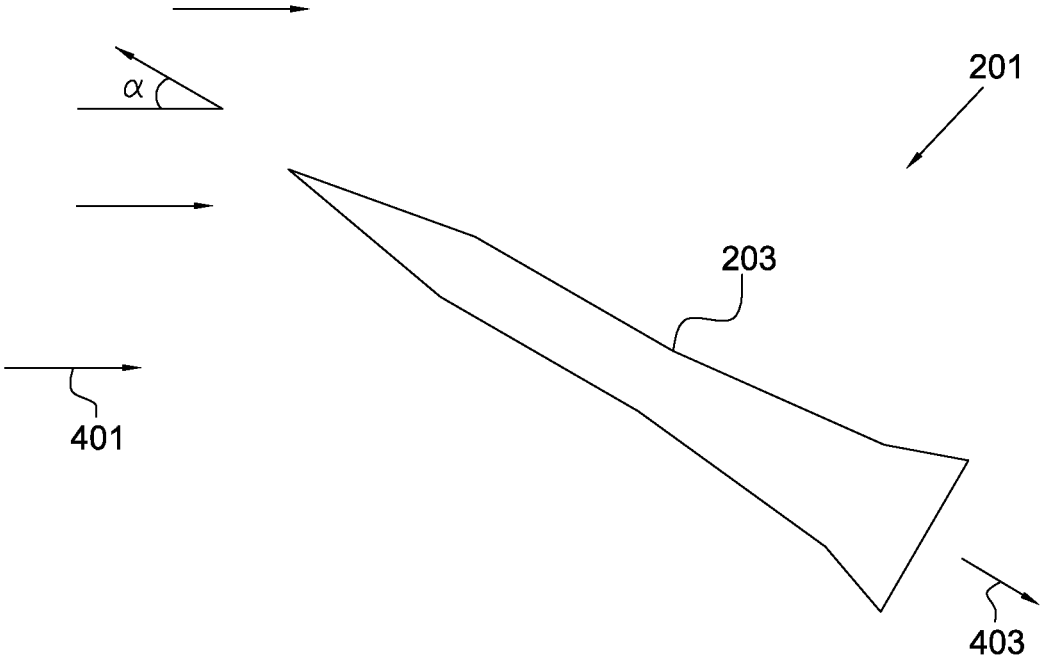
FIG. 4 is a side view of the system of FIG. 2 at a flight angle of attack.

In FIG. 4, a side view of system 201 is shown wherein the body is tilted and an angle "alpha" within the air stream 401. The figure also includes an arrow 403 indicating the jet speed of the object 203. The jet exit velocity injected normal to the surface body with a range of Mach number ratio from 1 to a maximum of 1.5. The Mach number ratio is defined as the free stream velocity to jet exit velocity.

Figure 5:
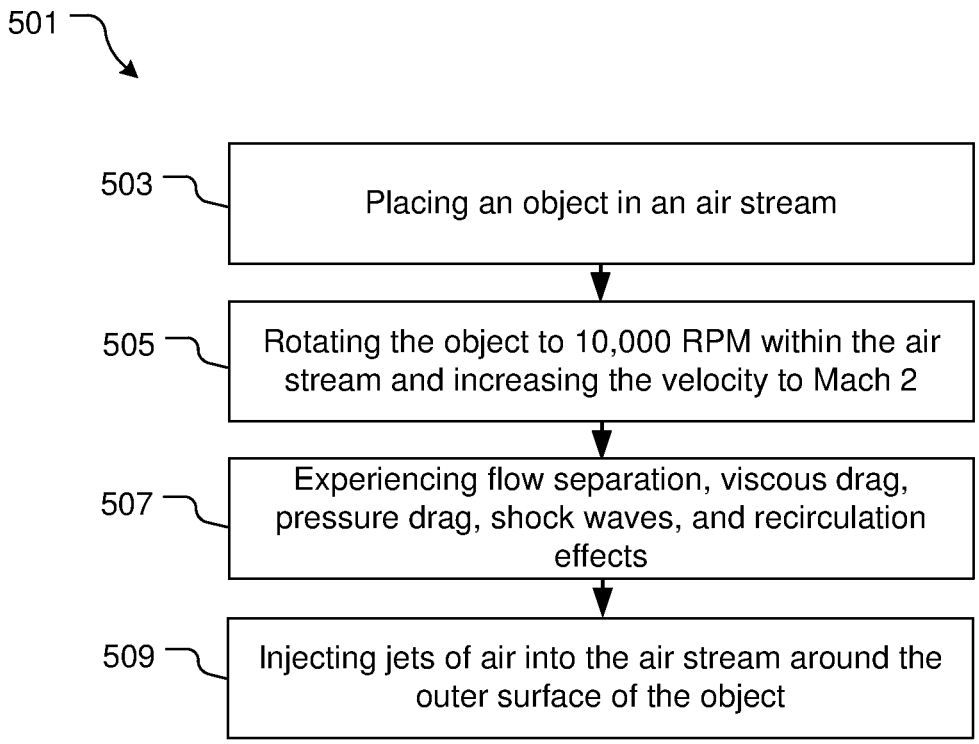
FIG. 5 is a flowchart of the preferred method of use.

In FIG. 5, a flowchart 501 depicting the changes in flight performance are shown. The first step is to take an object and place it in into the airstream, then rotating the object to approximately 10,000 RPM along with a speed of about Mach 2. After experiencing flow separation, viscous drag, pressure drag, shock waves, and recirculation, injecting a plurality of jets into the air stream to increase efficiency. These features are shown in boxes 503-509 in FIG. 5. The following figures will show the contour plots of Mach number and the pressure distribution that are function of angle of attack, Reynolds number and velocity of the jet exit as the jets are injected in the air stream, as discussed in flowchart 501. The drawings also show the creation of bow shock, boundary layer separation and recirculation region. It should be observed that changing one or more of these features alters the flow characteristics around the body.

The present invention is directed to an object wherein the transverse jet characteristics issuing from a three-dimensional body of revolution into a high speed external flow. This phenomenon creates a complex flow field whose influence upon the flow structure is not always easy to predict and to simulate. In FIGS. 6-10, different flow characteristics of the air stream around the body 203 are shown when taken from test data.

Figure 6:
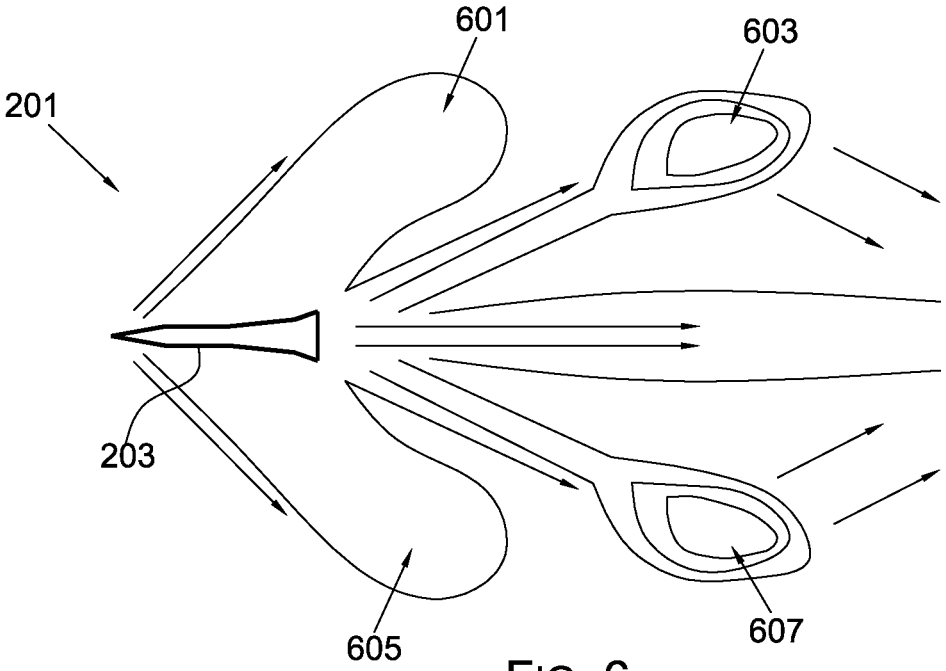
FIGS. 6-10 are side views of the system of FIG. 2 showing different flow streams around the rotating body.
Figure 7:
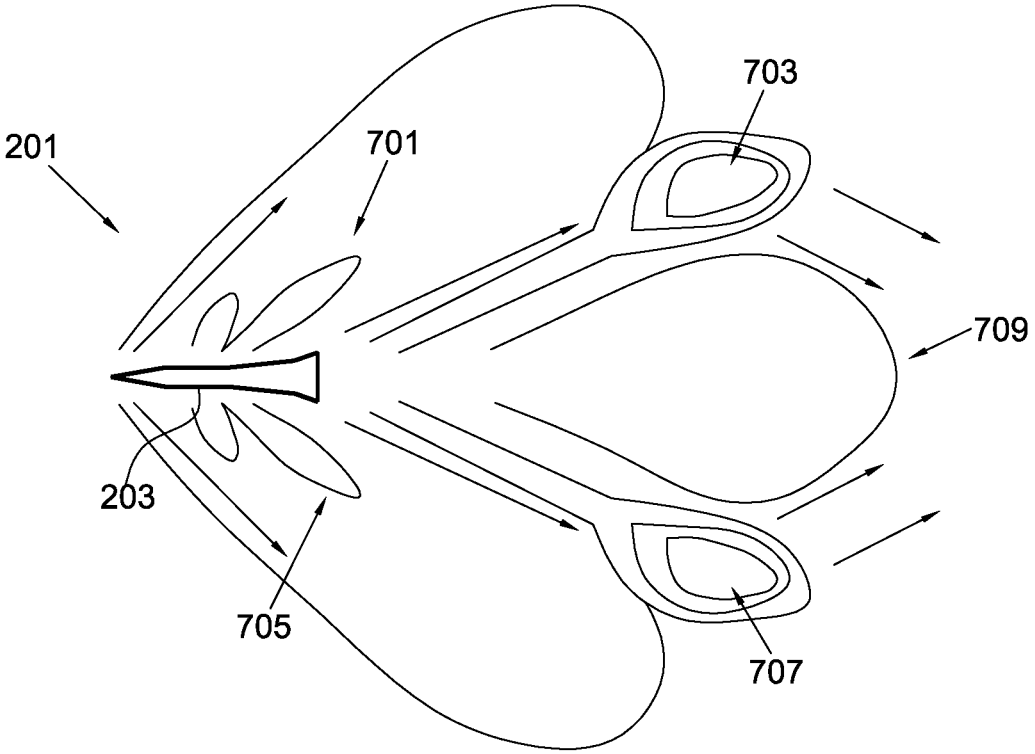

In FIG. 6, contour plots of the Mach number showing oblique shock waves and jet interactions are shown. These features are shown with areas identified with marker numbers 601, 603, 605, and 607. It is shown the creation of oblique shock waves in the front of the deflected streams in FIG. 6 as a result of the jet injected in the air stream passing over the object. In FIG. 7, contour plots of static pressure show oblique shock waves and jet interactions around the body. These features are shown with areas identified with marker numbers 701, 703, 705, 707, and 709.

Figure 8:
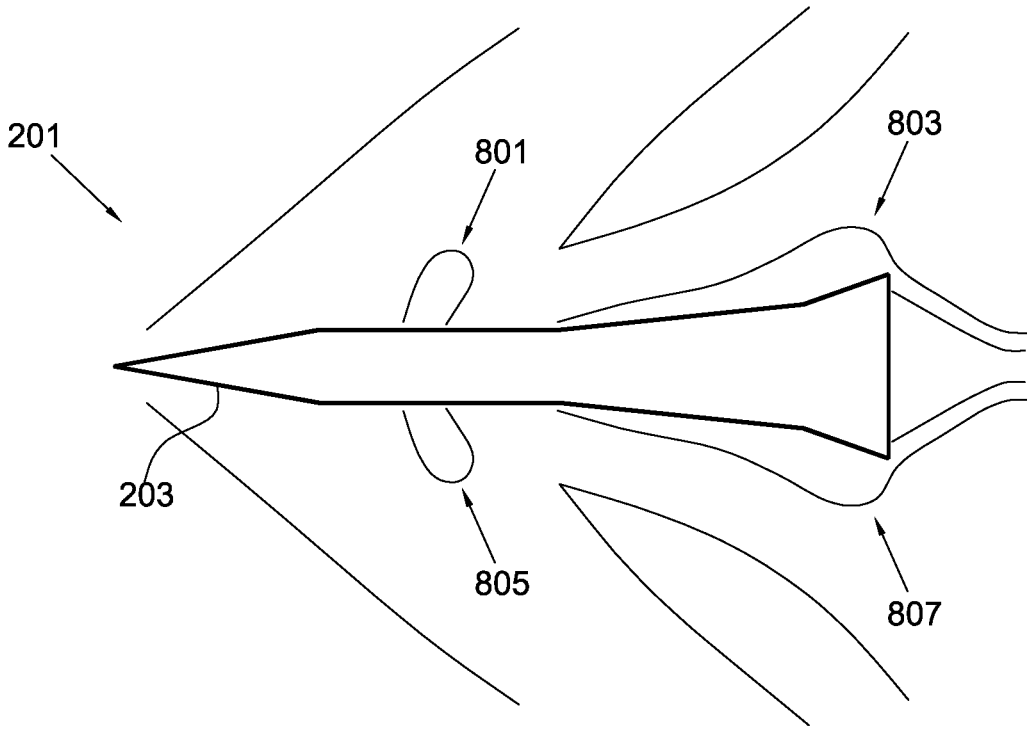

In FIG. 8, the contour plots of Mach number show the oblique shock waves and jet interaction of the complete body in a close-up view. These features are shown with areas identified with marker numbers 801, 803, 805, and 807. The figure shows contour plots of Mach number showing oblique shock waves and Jet interaction of complete body, close-up view. One can see the creation of the oblique shock waves, the expansion waves and the waves interactions with the transverse jets.

Figure 9:
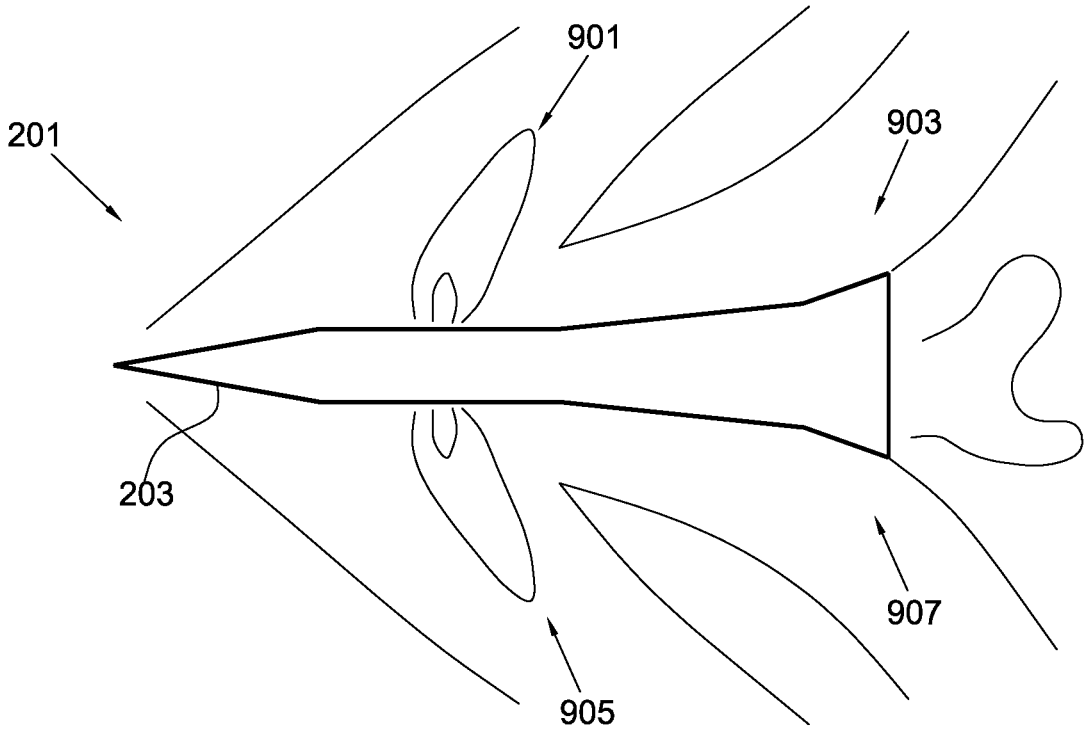

In FIG. 9, the contour plots of static pressure show the oblique shock waves and jet interaction of the complete body in a close-up view. These features are shown with areas identified with marker numbers 901, 903, 905, and 907. In this figure, it is observed the creation of the oblique shock waves, the expansion waves and the waves interaction with the transverse jets.

Figure 10:
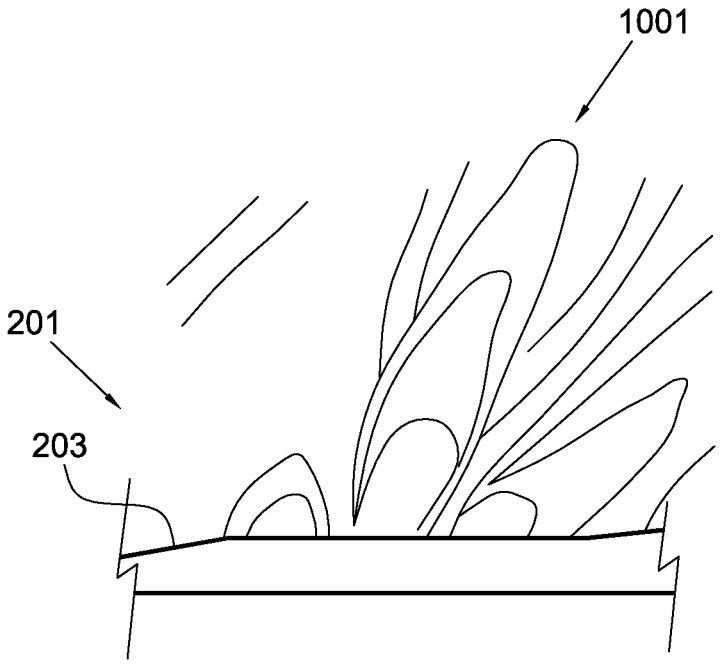

In FIG. 10, the contour plots of static pressure show the oblique shock waves and jet interaction of the complete body in a close-up view. These features are shown with areas identified with marker number 1001. It can be observed the creation of the oblique shock waves, the expansion waves and the waves interactions with the transverse jets.

Overall, it is shown that adding a transverse jet will change the flow structure around and behind the body especially with regard to viscous drag and pressure drag, shock waves interactions, boundary layer separations, recirculation and wake.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A system, comprising:

an elongated cylindrical body, having:

a first end extending to a second end;

an outer surface and an inner surface;

a thickness extending from the inner surface to the outer surface; and a plurality of openings extending from the inner surface to the outer surface;

a fluid injection apparatus disposed within the elongated cylindrical body, the fluid injection apparatus is configured to pass fluid through the openings;

wherein the elongated cylindrical body travel through a jet stream;

wherein the elongated body rotates within the jet stream; and wherein the elongated body rotates at approximately 10,000 RPM.

2. The system of claim 1, wherein the elongated cylindrical body travels through the jet stream at a high speed.

3. The system of claim 2, wherein the high speed is approximately Mach number 2.

4. The system of claim 1, wherein the elongated cylindrical body travels at an angle through the jet stream.

5. The system of claim 1, wherein the fluid injection apparatus is configured to inject a jet of fluid into a boundary layer surrounding the outer surface of the elongated cylindrical body as a function of angle of attack, Reynolds number, and velocity of the jet exit.

6. The system of claim 1, wherein the elongated body travels within the jet stream at approximately Mach number 2.

7. The system of claim 1, wherein the location of the plurality of openings is approximately ⅓ length of the elongated body from a tip of the first end.

* * * * *